United States Patent [19]

Bradford

[11] Patent Number: 4,626,639

[45] Date of Patent: Dec. 2, 1986

[54] APPARATUS FOR STABILIZING A KEYBOARD SWITCH ASSEMBLY AGAINST CANTILEVER MOVEMENT

[75] Inventor: Robert G. Bradford, Falkirk, Scotland

[73] Assignee: Burroughs Corporation, Detroit, Mich.

[21] Appl. No.: 630,331

[22] Filed: Jul. 11, 1984

Related U.S. Application Data

[63] Continuation of Ser. No. 295,969, Aug. 25, 1981, abandoned.

[30] Foreign Application Priority Data

Dec. 5, 1980 [GB] United Kingdom ..... 8039047

[51] Int. Cl.[4] ..... H01H 3/12

[52] U.S. Cl. ..... 200/340; 200/159 R; 400/496

[58] Field of Search ..... 200/5 A, 159 R, 340, 200/329, 338, 292, 333, DIG 1; 400/490, 491.2, 492, 496; 340/365 R; 235/145 R

[56] References Cited

U.S. PATENT DOCUMENTS

| | | | |
|---|---|---|---|
| 3,916,150 | 10/1975 | Abernethy et al. | 200/340 |
| 3,940,578 | 2/1976 | Pointon | 200/159 R X |
| 4,384,796 | 5/1983 | Denley | 400/496 |
| 4,453,063 | 6/1984 | Wanatowicz, Jr. et al. | 200/340 |

*Primary Examiner*—Charles E. Phillips
*Assistant Examiner*—Ernest G. Cusick
*Attorney, Agent, or Firm*—Mark T. Starr; Kevin R. Peterson

[57] ABSTRACT

A depressible shaft (14) mounted, switch (16) operating keyboard button (10) is stabilized against rotation about the shaft (14) and in a plane which includes the axis of the shaft (14) by means of a stabilizing arm (24) thereunder which engages a stabilizing surface (30) on the housing of the switch (16).

17 Claims, 5 Drawing Figures

APPARATUS FOR STABILIZING A KEYBOARD SWITCH ASSEMBLY AGAINST CANTILEVER MOVEMENT

This is a continuation of co-pending application Ser. No. 295,969, filed on Aug. 25, 1981, now abandoned.

The present invention relates to an electrical keyboard wherein a button and shaft assembly is depressible to operate a switch.

It is well known to provide an electrical keyboard comprising one or more keys each consisting of an operator depressible button atop a depressible, switch-operating spring restored shaft.

It is also well known to provide a keyboard wherein certain of the buttons, notably those most frequently used and/or those designed for access by the less mobile digits, are of larger dimensions than the other buttons, of which the space bar of a typewriter keyboard is an example.

There are various desirable properties of a depressible keyboard button. Firstly, the button should be reliable in operation, that is, it should never resist depression, and, having been depressed, it should never stay depressed when the depressive force is removed. Secondly, the button should be stable, that is, it should maintain a predetermined attitude as it is depressed. Thirdly, the button should have the correct elastic restitution coefficient so that the operator may have positive tactile feedback. Fourthly, and lastly, the button should have the correct amount of travel for its operation. While the first desirable property is an engineering requirement, the second to fourth desirable properties are also aesthetic in nature and are contributory to subjective assessment of keyboard quality and confidence therein. Aesthetic considerations are of increasing commercial significance. The desirable properties also reflect the efficiency with which an operator can operate the keyboard and the speed and ease of operation of an optimized keyboard is manifest testimony to its quality.

It is usual that an electrical keyboard key of the type described is constructed around a mass produced switch assembly. The switch assembly generally consists of a shaft entering a switch housing through guides. Inside the housing a restoring spring resists the insertion of the shaft. The shaft causes the making or breaking of an electrical circuit when inserted into the housing beyond a predetermined limit. A button is affixed to the distal end of the shaft by means of collets and the like. The guides are intended to maintain the axis of the shaft parallel to the direction of depression, and, in the case of a non-circular shaft entering the housing through complementary, non-circular guides, to prevent rotation of the shaft about its axis.

For ease of mass production at resonable unit cost it is necessary that the shaft be a relatively loose fit in the guides. The majority of keyboard buttons are small, being commensurate in area to the end of a digit. A fingertip is semi-elastic in nature, and applies a force over its area rather than at a point. The spreading of the force means that the mean point of application of the force cannot be far from the center of a small button. The torque induced in the button causing it to rotate on a plane which includes the axis of the shaft is therefore small. The low restitution forces from the reaction of the loosely-fitting shaft in the guides are therefore sufficient to maintain the small area button in a reasonably constant attitude as it is depressed.

Large area on the other hand can receive their depressive force with a mean point of application far removed from the point of attachment of the button to the shaft. The considerable torque so induced causes the loosely fitting shaft to rock in its guides and to counteract the torque by reaction forces of the shaft against the walls of the guides, whose vertical component, resultant from the coefficient of friction of the shaft against the guides, resists the depression of the button. In the worst case the button cannot be depressed at all and may, if successfully depressed, remain in the depressed state. Large area buttons are commonly found on the periphery of keyboards, far removed from the center of the operator's hand and consequently, when depressed, also receive considerable transverse forces inducing button rotation about the shaft. As well as being aesthetically most undesirable, this effect also induces depression resisting reaction forces between the shaft and its guides.

The problem may be ameliorated by the choice of low coefficients of friction between shaft and guides. When this is done by choice of materials, it is found that materials, particularly polymeric resins, which possess a low coefficient of friction also have considerable elasticity and give the button undesirable freedom of movement. When this is done by using lubricants, the lubricants can wear off over the considerable lifetime of the keyboard.

It is known to provide large area keys with more than one switch thereunder so that, supported by more than one shaft, the attitude of the button may be rendered more stable. This incurs a cost penalty and does little towards preventing the problems associated with a sticky shaft. The risk of having a sticky shaft supporting the button is increased by a factor equal to the number of switches employed.

The use of commonly available mass produced switch assemblies means that the spring force and extent of travel of the button is determined by the switch manufacturer. The manufacturer chooses these values to be the best compromise between the various requirements which users may put upon his switch.

In order that the user may have some means of determining for himself the elastic depressing resisting force of the spring experienced by the operator at the start of button depression, it is desirable that means be provided whereby the shaft can be predepressed to have, as its spring-restored restpoint, a user determined position, prior to the point where the shaft operates the electrical switch, where the spring force is equal to or more nearly equal to that desired by the user.

In order that the user may determine for himself the extent of travel of the button, it is further desirable that means be provided whereby the point of maximum depression of the button may be user determined at any point beyond the operating point of the electrical switch.

A switch is hereinafter defined as comprising an elastically restored electrical switch together with its housing and guides.

The present invention consists in a keyboard key wherein a button and shaft assembly is depressible along the axis of the shaft to operate a switch, said switch comprising a bearing surface parallel to the axis of said shaft and said assembly comprising a stabilizing arm in sliding engagement with said surface and effective to support said assembly against rotation in a plane containing said axis.

It is preferable that the arm and surface are further effective to support said assembly against rotation about said axis.

It is further preferable that the arm is effective to engage a withdrawal stop to prevent the withdrawal therebeyond of said assembly from said switch, and/or to engage an insertion stop for preventing the insertion therebeyond of said assembly into said switch.

In a first preferred embodiment a stabilizer is affixed together with a button, preferably by means of a collar, to the depressible shaft of a switch. The stabilizer preferably has a vertical member extending from the button to the level of the switch housing on the distal end of which a bearing member extends to intimately engage, by means of a stabilizing surface, a switch bearing surface on the casing of the switch. The two surfaces are parallel to the direction of depression of the shaft. The switch bearing surface is preferably integral with the switch casing. The switch bearing surface preferably includes a travel limiting stop or stops for engaging the bearing member. The two surfaces are preferably planar, in which case the switch casing is preferably of rectangular right prismatic form.

In a second preferred embodiment a circular button is affixed to a depressible circular shaft coaxially insertable into a circularly cased switch. A stabilizer is preferably affixed to the shaft to have a vertical member descending to the level of the switch and to have a bearing member extending from the vertical member to engage the circular casing of the switch. The stabilizer is preferably an integral part of the switch and shaft assembly.

In a third preferred embodiment a keyboard bar is, at one of its ends, affixed to a depressible switch-operating shaft and at the other of its ends engages a bearing surface on a bearing block via a stabilizer similar to the stabilizer of the first preferred embodiment.

The invention is further explained, by way of an example, by the following description in conjunction with the appended drawings, in which:

FIG. 1 shows a cross sectional view of a keyboard key, according to the prior art, wherein no stabilizing measures have been taken.

Figure 1:
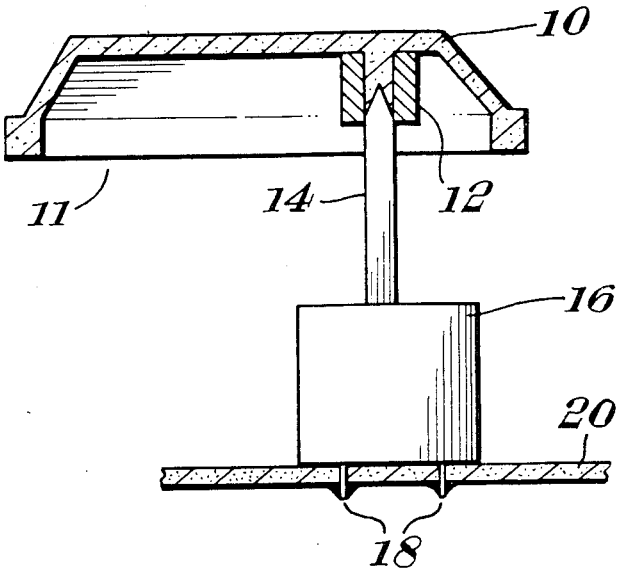
Fig. 1 PRIOR ART
FIG. 1 shows a keyboard key according to the prior art.

A digitally depressible button 10 is non-centrally affixed, to have an overhang 11, by means of a collet 12 to the shaft of an electrical switch 16. The switch 16 is provided with a casing in the form of a rectangular right prism. The switch 16 is in turn affixed by solder lugs 18 to a baseboard 20 whereon a plurality of keys can be so affixed to form a keyboard. The shaft 14 is depressible by the button 10 to operate the switch 16 against the restoring force of a spring contained within the switch casing. The shaft 14 is rectangular in its cross-section taken traversely to its direction of depression and enters the switch 14 through a corresponding rectangular opening having walls extensive in the direction of depression of the shaft and intended to act as guides to prevent its tilt and rotation. The direction of the overhang 11 of the button 10 with respect to the shaft 14 is arranged to lie in a direction 14, which is normal to one of the faces of the switch casing.

Figure 2:
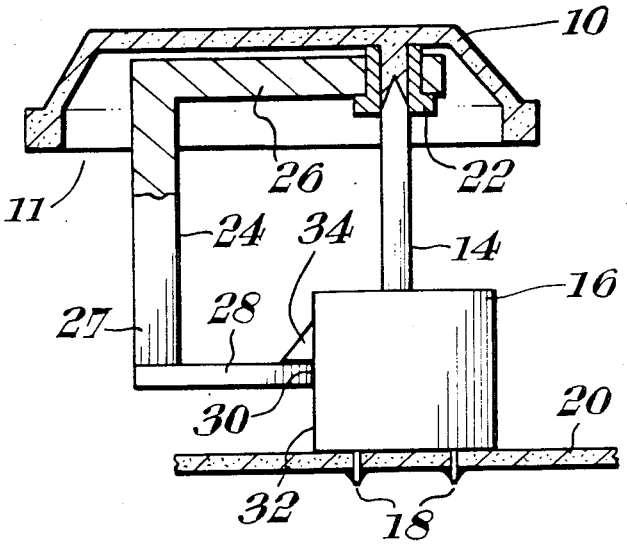
FIG. 2 shows the key of FIG. 1 inclusively of the first embodiment of the invention.

FIG. 2 shows a cross sectional view of the stabilized key of the first preferred embodiment.

The key of FIG. 1 is provided with a stabilizer 24 coupled to the button 10 and the shaft 14 by a modified collet 22. The stabilizer 24 comprises a support arm 26 for supporting the overhang 11 of the button 10, a vertical arm 27 affixed to the distal end of the support arm 26 and extending downwards to the level of the switch 16, and a bearing arm 28 extending from the lower end of the vertical arm 27 to contact, by means of a stabilizer bearing surface 30, a switch bearing surface 32 on the casing of the switch 16.

A stop 34 is provided at the upper end of the switch bearing surface 32 for engaging the bearing arm 28 to prevent the extraction, beyond the point where that engagement occurs, of the shaft 14 from the switch 16.

Figure 3:
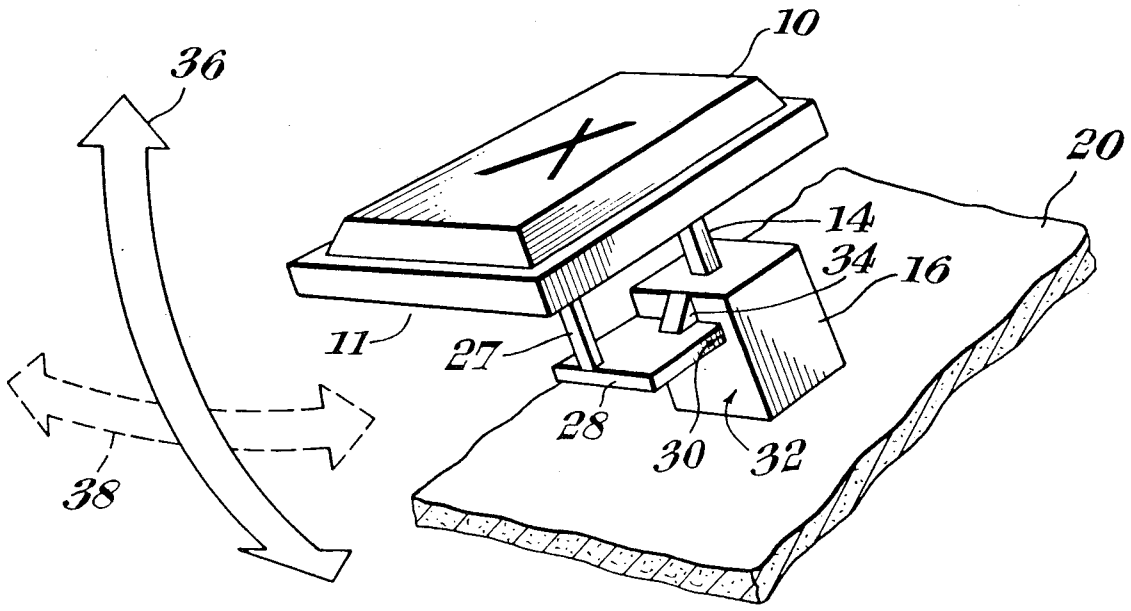
FIG. 3 shows an isometric view of FIG. 2.

FIG. 3 shows an isometric view of the stabilized key of FIG. 2.

If a depressive force is applied to the overhang 11 of the button 10 rotation is induced in the direction of the first arrow 36, i.e. in a plane which includes the axis of the shaft 14. The stabilizer bearing surface 30 presses against the switch bearing surface 32 to generate a reaction force which opposes the rotation. The reactive opposition to the rotation is transferred to the button 10 and the shaft 14 by the supportive action of the stabilizer 24 to achieve tilt stabilization.

The stabilizer bearing surface 30 and the switch bearing surface 32 are both planar and are in intimate contact with one another. If a rotational force is applied to the button 10, tending to rotate the button 10 about the axis of the shaft 14, as indicated by the second arrow 38, the change in distance from the axis of the shaft 14 that the rotation would entail for at least some points on the stabilizer bearing surface 30 is opposed by reactive forces generated against the switch bearing surface 32, all points of which are fixed relative to the intended axis of the shaft 14. The reactive forces so generated are transferred to the button 10 by the stabilizer 24 and the rotation is opposed to achieving rotational stabilization.

It is to be appreciated that a second stop can be provided to engage the bearing arm 28 at a lower limit of depression of the shaft 14. The stop or stops can be fabricated integrally with the switch casing or can be applied to the switch casing separately. Similarly, the switch bearing surface 32 can be integral with the switch casing or affixed to a pre-manufactured switch as part of a separate switch bearing surface assembly. Any stop or stops associated therewith can be integral with that assembly.

It is further to be appreciated that the switch bearing surface 30 and the stabilizer bearing surface 32 need not be planar. They can be any mutually engaging portions of right-cylindrical surfaces parallel to the direction of depression of the shaft. All such surfaces achieve tilt stabilization and all except right cylindrical surfaces centered on the axis of the shaft 14 achieve rotational stabilization. The surfaces 30,32 need not be continuous. Each can comprise a plurality of separate sections FIG. 4 shows an isometric view of the second preferred embodiment of the invention.

A circular depressible button 40 operates a circular switch 42 via a circular shaft 43. A modified stabilizer 44, instead of being affixed to the button 40, is cojoined with the shaft 43. A modified bearing arm 46 engages the circular casing of the switch 42 and stabilizes it only against tilt. The modified stabilizer 44 may be affixed to the shaft by collars and the like, or included in the manufacture of the switch 42 as an integral part of the switch assembly.

It is to be appreciated that the stabilizing arm 24 of the first preferred embodiment may similarly be affixed to the shaft 14 instead of the button 10 provided that the collet 12 attaches the button 10 to the shaft 14 sufficiently rigidly to transfer tilt and rotation opposing forces to the button.

Figures 4, 5:
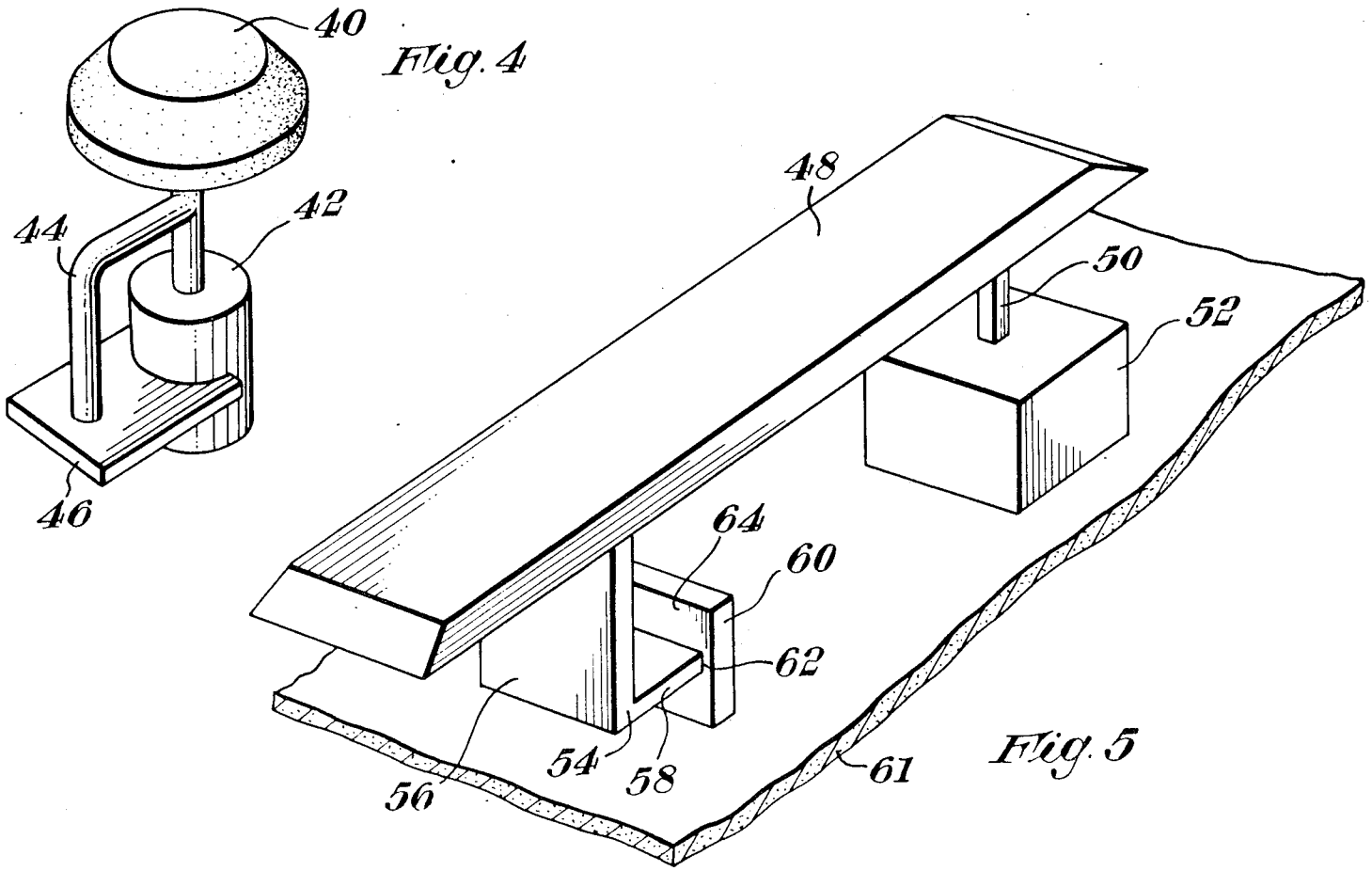
FIG. 4 shows the second preferred embodiment of the invention.
FIG. 5 shows the third preferred embodiment of the invention.

FIG. 5 shows the third preferred embodiment of the invention.

One end of a depressible bar 48 is affixed over a shaft 50 and operable to depress that shaft 50 to operate a switch 52. A bar stabilizer 54 is affixed beneath the bar 48 to have a vertical member 56 extending to the level of the switch 52 at the other end of the bar 48. The stabilizer 54 is similar to the stabilizer 24 of the first embodiment shown in FIG. 2. The stabilizer 54 can also be fabricated as an integral part of the bar 48. A bearing member 58 extends from the lower end of the vertical member 56 to engage a stabilizing block 60 which is attached to the same baseboard 61 as the switch 52, the stabilizing block 60 is separate from the switch 52. The bearing member 58 is provided with a planar stabilizing surface 62 which intimately engages a planar bearing surface 64 to achieve tilt and rotational stabilization in the same manner as does the first preferred embodiment. The surfaces 62, 64 are subject to the same possibilities of variation as the surfaces 30,32 of the first preferred embodiment.

In all of the above embodiments it is to be appreciated that, although only one stabilizer has been shown and described in association with each button, it is perfectly possible to provide each button with more than one stabilizer for preventing tilt in more than one direction.

We claim:

1. A stabilizing apparatus for reducing cantilever movement of a button operating a switch assembly on a baseboard in an electrical keyboard, said switch assembly including a shaft and a housing, said shaft being depressibly insertable into said housing to operate said switch assembly, said button being affixed at the distal end of said shaft for the depression thereof, said switch housing including a first bearing surface parallel to the direction of depression of said shaft, said shaft and said button being subject to the receipt of depressive forces in a preferred direction off-center from the axis of said shaft to cause said cantilever movement of said button, said apparatus comprising:

stabilizing arm means for reducing said cantilever movement of said button, said stabilizing arm means being rigid, said stabilizing arm means coupled in rigid relationship to said shaft, said stabilizing arm means having a first surface rigidly coupled to said shaft and a second surface in free sliding cooperation with said first bearing surface to thereby permit depression of said button.

2. The apparatus of claim 1 wherein said second surface and said first bearing surface are planar.

3. The apparatus of claim 1 wherein said stabilizing arm means includes a first member connected to said first surface, said first member supportively extensive beneath said button, a second member coupled to said first member and extending toward said baseboard, and a third member coupled to said second member and extensive to said second surface.

4. The apparatus of claim 1 in which said second surface and said first bearing surface are curved surfaces.

5. A stabilizing apparatus for reducing cantilever movement of a button operating a switch assembly on a baseboard in an electrical keyboard, said switch assembly including a shaft and a housing, said shaft being depressibly insertable into said housing to operate said switch assembly, said button being affixed at the distal end of said shaft for the depression thereof, said switch housing including a first bearing surface parallel to the direction of depression of said shaft, said shaft and said button being subject to the receipt of depressive forces in a preferred direction off-center from the axis of said shaft to cause said cantilever movement of said button, said apparatus comprising:

a rigid stabilizing arm for attachment in rigid relationship to said shaft, said stabilizing arm comprising a single rigid support arm for extending away from said shaft beneath said button in said preferred direction to support said button against the cantilever movement, said support arm including a remote portion further from the axis of said shaft than the nearest part of said first bearing surface is distant from the axis of said shaft;

a vertical arm extending from said remote portion of said support arm in the direction of depression of said shaft;

a bearing arm extending parallel to said preferred direction from the distal end of said vertical arm towards said first bearing surface; and a second bearing surface on the distal end of said bearing arm for engaging said first bearing surface to provide free sliding cooperation therebetween to permit depression of said shaft and to provide reactive forces between said housing and said bearing arm in preventative opposition to said cantilever movement.

6. An apparatus according to claim 5, wherein said second bearing surface is adapted to be conformal with said first bearing surface for intimate engagement therebetween.

7. An apparatus according to claim 6, wherein said stabilizing arm is attachable to said shaft together with said button by means of a common collect.

8. An apparatus according to claim 6, wherein said stabilizing arm is affixable directly to said shaft.

9. An apparatus according to claim 5, wherein said first and second bearing surfaces are planar.

10. An apparatus according to claim 9, wherein said stabilizing arm is attachable to said shaft together with said button by means of a common collet.

11. An apparatus according to claim 9, wherein said stabilizing arm is affixable directly to said shaft.

12. An apparatus according to claim 5, wherein said first bearing surface is a portion of a right cylindrical surface with directrix parallel to said axis of said shaft and with a non-circular generatrix, and wherein said second bearing surface is operable to cooperate with said first bearing surface to oppose rotation of said button about said axis of said shaft.

13. An apparatus according to claim 12, wherein said stabilizing arm is attachable to said shaft together with said button by means of a common collet.

14. An apparatus according to claim 12, wherein said stabilizing arm is affixable directly to said shaft.

15. An apparatus according to claim 5 wherein said stabilizing arm is attachable to said shaft together with said button by means of a common collet.

16. An apparatus according to claim 5, wherein said stabilizing arm is affixable directly to said shaft.

17. An apparatus according to one of claims 6–14, wherein said first bearing surface comprises at least one stop, said bearing arm engagable with said at least one stop.

* * * * *